US005390502A

United States Patent [19]

Storbeck et al.

[11] Patent Number: 5,390,502

[45] Date of Patent: Feb. 21, 1995

[54] NON-FREEZE CLOSED LOOP EVAPORATED COOLING SYSTEM

[75] Inventors: Robert D. Storbeck, Brookfield; Walter D. Olson, Oconomowoc, both of Wis.

[73] Assignee: Oven Systems, Inc., Milwaukee, Wis.

[21] Appl. No.: 219,391

[22] Filed: Mar. 29, 1994

[51] Int. Cl.[6] ..... F25D 17/06

[52] U.S. Cl. ..... 62/91; 62/310; 261/DIG. 46; 261/97; 261/DIG. 11; 261/72.1

[58] Field of Search ..... 62/91, 171, 305, 310, 62/314; 261/DIG. 46, 97, DIG. 11, DIG. 77, 72.1

[56] References Cited

U.S. PATENT DOCUMENTS

| | | | |
|---|---|---|---|
| 1,861,158 | 5/1932 | Hilger | 62/171 |
| 2,068,478 | 1/1937 | Bergdoll . | |
| 2,213,622 | 9/1940 | Carraway . | |
| 2,498,017 | 2/1950 | Stutz | 62/171 |
| 3,026,690 | 3/1962 | Deverall . | |

FOREIGN PATENT DOCUMENTS 845844 2/1959 United Kingdom .

*Primary Examiner*—John M. Sollecito

*Attorney, Agent, or Firm*—Andrus, Sceales, Starke & Sawall

[57] ABSTRACT

A precooling system for an evaporative cooler for a closed loop cooling fluid system includes a supplemental heat exchanging coil connected in the cooling fluid loop upstream of the main evaporative cooler coils and positioned in the outlet air flow through the evaporative cooler, but above or outside the path of the spray water. The supplemental heat exchanging coil provides enough additional cooling capacity to allow the spray water system to be completely shut off and the spray water sump drained during low outside ambient temperature operation. Freeze up of the sump and other parts of the spray water system are completely eliminated and a substantial saving in spray water consumption and energy for freeze prevention systems is realized.

7 Claims, 1 Drawing Sheet

NON-FREEZE CLOSED LOOP EVAPORATED COOLING SYSTEM

BACKGROUND OF THE INVENTION

The present invention pertains to evaporative cooling systems and, more particularly, to an evaporative cooler for cooling process fluid in a closed system.

Closed loop evaporative coolers for cooling process water or other fluids in industrial applications are well known in the art. Such units are usually mounted outside the factory building, typically on a roof, where process fluid used to cool industrial equipment and machines inside the factory is directed for cooling and returned for recirculation through the equipment. In a typical evaporative cooler, a number of vertically spaced horizontally disposed banks or tiers of cooling coils are supported within a housing through which a flow of outside ambient air is induced with a fan or fans to direct cooling air into the housing and up through the tiers of coils. A spray water system, including a header and nozzle arrangement, is positioned above the uppermost tier of the main cooling coils within the housing to direct a spray of water downwardly over the coils and counter to the upward flow of cooling air. The evaporative effect of the spray water supplements the effect of the cooling air flow, all in a well known manner, to cool the process water or other cooling fluid which is continuously pumped through the serially connected banks of cooling coils.

In the use of evaporative coolers in temperate climates where operation at below freezing temperatures in winter months is required, steps must be taken to prevent freeze up of the spray water system, including the prevention of freezing in the spray water sump at the bottom of the unit where the spray water is collected and recirculated by pump to the spray header. Electric heaters or other types of heating equipment must be placed in the spray water sump to prevent freeze up in cold weather. Such heating systems add substantially to the operating costs of an evaporative cooler and, in extremely cold weather, spray water passing through the cooling coils still freezes and results in decreasing operating efficiencies. Also, the operation of spray water systems in evaporative coolers in a range of ambient temperature conditions both below and above zero often results in a characteristic formation of a plume of water vapor which is aesthetically undesirable.

It is known in the prior art to position precooling coils above the spray water header and connect the same in series with the main cooling coils in the condenser unit for a refrigeration system. U.S. Pat. No. 2,068,478 shows one such system. However, operation of the evaporative cooler includes continuous operation of the spray water system and, in addition, the precooling coils are substantially larger in size and in basic cooling capacity than are the main evaporative cooling coils.

U.S. Pat. No. 3,026,690 shows a similar system, but with a modification wherein the precooler coils and the main evaporative cooler coils though serially connected are positioned in parallel passages within the cooler housing. Thus, the precooler coils are not positioned above the spray water header so as to receive the same flow of cooling air as the main cooling coils.

U.S. Pat. No. 2,213,622 discloses an evaporative cooling unit which includes a precooling coil positioned within the cooler housing and in the flow of cooling air. The precooling coil is located immediately above the spray water header. The system includes a temperature responsive control which operates to shut off the flow of spray water as the temperature drops below freezing.

British patent specification 845844 also discloses a supplemental finned precooler positioned in the housing of an evaporative cooler above the spray water cooling system. One of the functions of the fins of the precooling coils is to act as a mist eliminator by trapping airborne spray water particles to separate the water from the cooling air discharged from the unit.

SUMMARY OF THE INVENTION

In accordance with the present invention, an evaporative cooler and its method of operation are modified to provide complete shutdown of the spray water system during freezing conditions by providing temperature responsive control of the spray water system and utilizing a simple and inexpensive supplemental precooler coil directly in the path of the cooling air through the unit.

The apparatus and method of the present invention are applicable to an evaporative cooler of the type having a closed loop cooling fluid circulation path including a main heat exchanging coil which is disposed in the path of an upward flow of cooling air and an downward flow of spray water. In its basic embodiment, the invention includes a supplemental heat exchanging coil which is operatively connected in series with the main heat exchanging coil, with the supplemental coil positioned upstream in the closed loop cooling fluid circulation path from the main coil and in the path of the cooling air flow, but outside the path of the spray water. Temperature responsive control means are provided to shut off the flow of spray water at a selected low ambient temperature and to subsequently turn on the flow of spray water at a selected high ambient temperature which is above the selected low temperature.

The typical evaporative cooler to which the system and method of the present invention are applicable includes a main housing which encloses a spray water distribution header and the main heat exchanging coil, and defines a generally vertical flow passage for the cooling air and a sump for the collection and recirculation of spray water. The system preferably includes means for mounting a supplemental heat exchanging coil to the upper end of the housing. The supplemental coil includes a metal tube formed in a serpentine pattern and disposed in a single generally horizontal plane. A housing extension laterally encloses the supplemental coil and extends vertically upward from the main housing. The metal tube for the supplemental coil preferably includes integrally attached thin metal cooling fins.

The temperature responsive control means in one embodiment is operative to drain the sump of spray water when the spray water flow is shut off and to cause the sump to be refilled at an intermediate ambient temperature between the low shut off temperature and the high turn on temperature. The high and low ambient control temperatures preferably define a range of about 10° F. with a low temperature of approximately 40° F. and a high temperature of about 50° F. In a presently preferred embodiment, the spray water system control operator to shut off the water supply and drain the sump at a selected low ambient temperature above freezing (e.g. 40°), and to refill the sump at an intermediate ambient temperature above the selected low temperature. The control preferably includes a suitable delay for restarting the pump.

In accordance with the method of the present invention, cool weather operation of the above described evaporative cooler includes the steps of: connecting a supplemental heat exchanging coil in series with the main heat exchanging coil; positioning the supplemental coil upstream with respect to the flow of cooling water in the main coil and in the path of cooling air flow, but outside the path of the spray water; shutting off the flow of spray water at a selected low ambient temperature; and, resuming the flow of spray water at a selected high ambient temperature.

DETAILED DESCRIPTION OF THE PREFERRED EMBODIMENT

Figure 1:
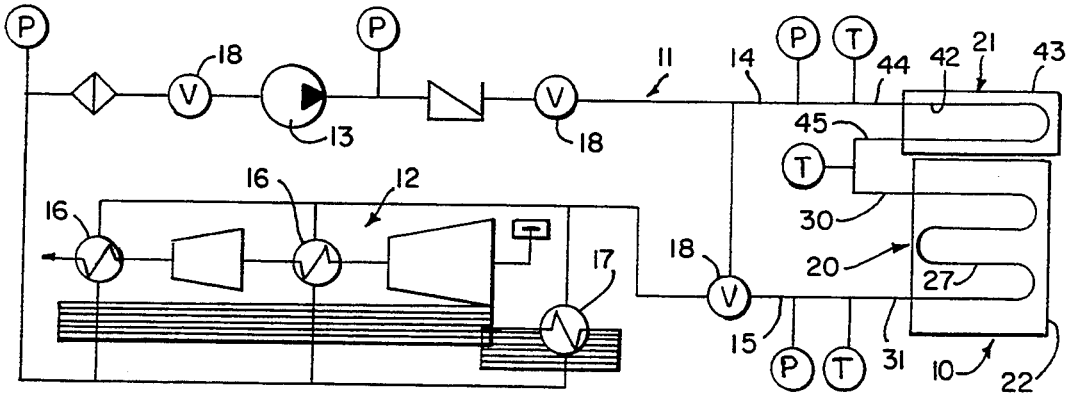
FIG. 1 is a schematic drawing of a closed loop evaporative cooling system showing a typical application to cool a large air compressor.

Referring first to the schematic showing in FIG. 1, an improved evaporative cooler 10 is shown installed in a closed loop cooling water line 11 providing cooling water to a two-stage air compressor 12. Cooling water is circulated through the line 11 by a main circulation pump 13 which directs heated cooling water to the evaporative cooler through an inlet line 14 and supplies cooled water to the compressor 12 via a cooler outlet line 15. Cooling water from the outlet line 15 is directed separately to a heat exchanger 16 for each stage of the compressor 12, as well as to an oil cooler 17 for the compressor. Temperature T and pressure P are monitored at various points in the closed loop system and the usual valves 18 to control flow are located at various points throughout the closed loop system 11, all in a well known manner. As an example, a 100 horsepower compressor 12 might require a cooling water flow of 20 gpm and an evaporative cooling capacity of 250,000 BTU per hour.

The improved evaporative cooler 10 of the present invention includes a lower evaporative cooler 20 of conventional construction to which is attached an upper precooler 21. The conventional evaporative cooler 20 includes an enclosing housing 22 which defines a lower cooling air inlet plenum 23 and an upper main cooling coil chamber 24. One side wall of the air inlet plenum 23 includes a series of air inlet openings 25 between which are mounted one or more air circulation fans 26. The main cooling coils 27 in the upper cooling coil chamber 24 are arranged in vertically spaced horizontal tiers 28, each of which comprises a serpentine array of tubes extending back and forth along substantially the full length of the chamber 24. In a conventional evaporative cooler 20, warmed process water from the inlet line 14 is supplied directly to the cooler inlet 30 for circulation through the main cooling coils 27 to a cooler outlet 31 connected to the system outlet line 15. The evaporative cooler 20 may, in accordance with a common feature, be constructed with two serially connected sets of main cooling coils which are connected by an intermediate outlet 32 and intermediate inlet 33, as shown. Inside the main cooling coil chamber 24 and above the uppermost tier 28 of main cooling coils, there is mounted a spray water system 34, including a supply header 35 and a series of spray water laterals 36 positioned parallel to one another and extending the full length of the cooler. Each lateral includes a series of generally downwardly directed spray nozzles 37. Spray water is supplied to the header 35 from a sump 38 in the bottom of the housing 22 by a spray water pump 40.

In conventional operation of the evaporative cooler 20, process water from inlet line 14 is directed to the cooler inlet 30 and circulated through the main cooling coils 27, while the fans 26 direct cooling air upwardly through the coils and the spray nozzles 37 direct evaporative cooling water downwardly to cascade over the tiers 28 of cooling coils where it is collected in the sump 38 at the bottom for continuous recirculation. Mist eliminator 41, comprising a series of generally vertically oriented curved plates, is attached to the upper end of the housing 22 above the spray water system 34. The mist eliminator provides a somewhat interrupted path to the flow of cooling air, causing water droplets entrained in the upward flow of air to be captured on the mist eliminator plates and fall back into the housing.

When the evaporative cooler 20 is located outside and must be operated during sub-freezing weather, steps must be taken to prevent freezing of the spray water, which could otherwise result in complete inoperability and extensive damage to the unit. One solution is to install electric heating coils or other types of heating units in the sump 38. Alternately, an auxiliary sump can be located indoors and the main sump 38 bypassed during cold weather operation. However, both of the foregoing options may be inadequate during extremely cold weather operation in Which spray water will freeze on the main cooling coils 27 regardless of the construction or location of the sump. Under such conditions, the spray water system 34 may be turned off completely and cooling effected only by the circulation of cooling air. However, the cooling air flow alone may be inadequate to provide the necessary cooling of the process water. Additional main cooling coils 27 may be provided in the evaporative cooler 20 so that adequate cooling capacity for cold weather operation without the spray water system is available. However, such additional cooling capacity is quite costly and normally not a cost-effective alternative.

Figure 2:
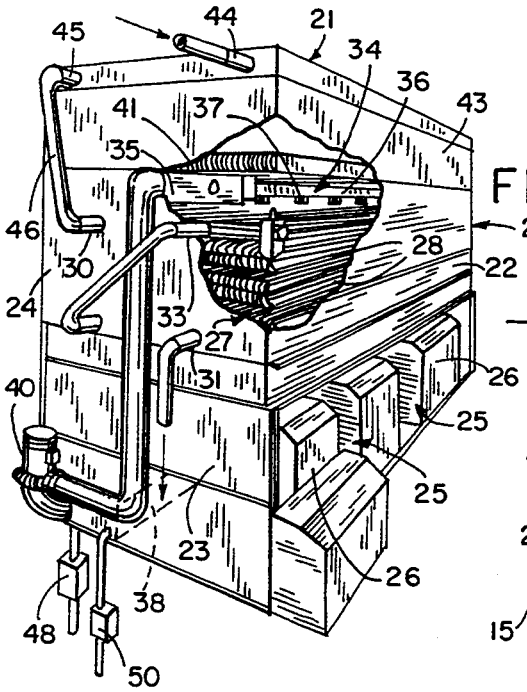
FIG. 2 is a perspective view of an evaporative cooler incorporating the precooler of the present invention.
Figure 3:
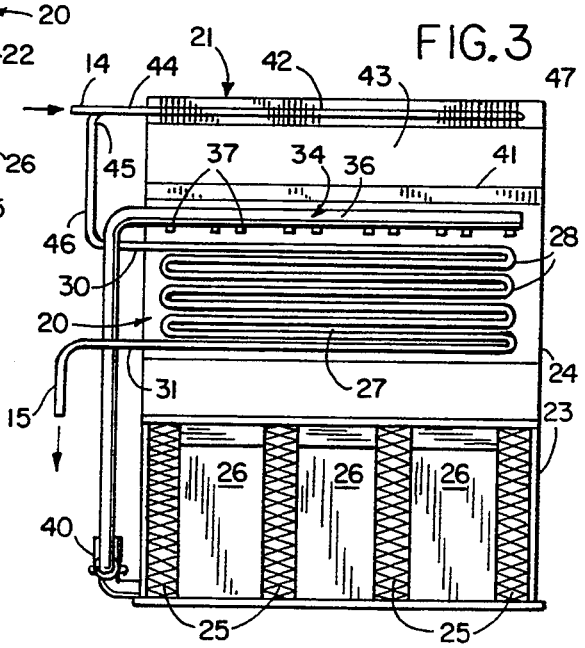
FIG. 3 is a side elevation of the evaporative cooler shown in FIG. 2.
Figure 4:
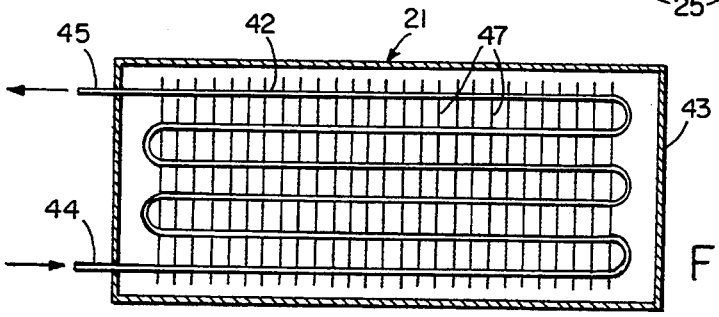
FIG. 4 is a top plan view of the apparatus shown in FIG. 3.

In accordance with the present invention, the precooler 21, comprising a single precooling coil 42, is connected in series with the main cooling coils 27 and is positioned upstream thereof with respective to the flow of process cooling water. The precooling coil 42 is located in the path of cooling air flow through the housing 22 but outside the path of the spray water supplied by the spray water system 34. Preferably, the precooling coil 42 is mounted inside an enclosing shroud 43 and the shroud is attached to the upper edge of the housing 22, as is best shown in FIG. 2. Thus, in the top plan view of FIG. 4, the rectangular shroud 43 is of the same size and shape as the rectangular housing 22.

The precooling coil 42 comprises a single continuous metal tube, such as copper, which extends in a horizontal serpentine path from a precooler inlet 44, connected to the inlet line 14, to a precooler outlet 45 which is attached to one end of a connecting line 46 to the evaporative cooler inlet 30. The precooling coil 42 includes a series of integrally attached thin metal cooling fins 47 which may be made of aluminum. The precooling coil 42 is arranged to cover substantially the full area within the shroud 43 so as to be directly in the path of the full cooling air flow exiting the main cooling coil chamber 24 through the mist eliminator 41.

The precooling coil 42 presents negligible additional resistance to air flow through the unit, yet may be sized to provide significant additional cooling capacity to the evaporative cooler, thereby allowing shut off of the spray water system 34 when the ambient temperature approaches the freezing level. In fact, the precooling coil 42 has been found to provide effective enough supplemental cooling to allow the spray water system to be shut off at temperatures substantially above freezing, thereby providing a measure of safety as well as a saving in the operation of the water system.

In a typical process water cooling system, such as that shown in FIG. 1, the entire evaporative cooler 10 may be required to reduce the temperature of the water in inlet line 14 by 20°–25° F. for supply to the equipment to be cooled via the outlet line 15. At outside ambient temperature of approximately 50° F. (about 10° C.), the precooling coil 42 will reduce the process water temperature by approximately 10° F. (5.5° C.) and the main cooling coils 27 (with the spray water system 34 shut off) will further reduce the temperature of the cooling water by 10°–15° F. at the evaporative cooler outlet 31 to the cooling system.

A suitable control system may be utilized to provide a control strategy which initially shuts off the spray water pump 40 when the ambient temperature drops to 40° F. (about 5° C.). The supply of spray water to the header 35 is shut off and, at the same time, the sump 38 is drained, either by gravity or by diverting the flow from the spray water pump 40 until the sump is empty. Once the spray water shut off temperature has been reached, the control system is designed to continue operation of the cooler 10 without spray water until the outside ambient temperature rises to a level somewhat above the shut off temperature such as, for example, 50° F. (10° C.). This deadband range of about 10° F. will prevent short cycling operation of the spray water system between shut off and turn on. As the ambient temperature rises to the selected high turn on temperature level, the spray water pump 40 or other suitable water supply system is activated to refill the sump 38. In order to assure a full sump and the availability of spray water as soon as the ambient temperature reaches the upper set point, the control may be operated to begin refilling the sump at a somewhat lower temperature above the low ambient temperature set point. Of course, other ambient control temperature levels above freezing may be suitably employed.

In a presently preferred control strategy for recommencing operation of the spray water system after automatic shut off and draining of the sump, the upper set point temperature (e.g. 50° F.) may be used to generate a signal to close the drain valve 48 from the sump 38, and to open the water supply valve 50 to refill the sump. The control preferably also includes a time delay feature which delays restart of the spray water pump 40 for a short period of time (e.g. 10 minutes) to assure that there is water in the sump so the pump does not operate without water.

In addition to the virtual elimination of cold weather freezing problems in evaporative coolers, the precooling system of the subject invention concurrently results in a substantial saving in the volume of spray water used, reducing the annual volume by as much as 30 to 40 percent. Savings are also realized in eliminating the energy required to heat the water in the sump to prevent freezing. Also, the maintenance problems typically associated with winter operation of the spray water system are eliminated. In addition, the finned precooler coil is not as readily subject to a detrimental build-up of dirt, debris and water-borne or water supported organisms because it is located outside the spray water system. It is also readily accessible for cleaning and maintenance, if needed. The precooling coil 42 provides a cooling capability which cannot economically and cost effectively be met by increasing the size of the main cooling coils 27. Finally, the precooling coil 42, constructed in a single tier, results in a very small air flow pressure drop (about ¼ inch $H_2O$ or 0.06 kPa), so that no increase in the capacity of the cooling fans 26 is required.

Various modes of carrying out the invention are contemplated as being within the scope of the following claims, particularly pointing out and distinctly claiming the subject matter which is regarded as the invention.

I claim:

1. A precooling and freeze protection system for an evaporative cooler of the type having a closed loop cooling fluid circulation path including a main heat exchanging coil which coil is disposed in a main enclosing housing defining a generally vertical path for an upward flow of cooling air and a downward flow of spray water from a spray water distribution header in the main housing to a sump, said precooling system comprising:

a supplemental heat exchanging coil operatively connected in series with the main heat exchanging coil, means for mounting said supplemental heat exchanging coil to the upper end of the main housing upstream of the main coil with respect to the flow of cooling fluid, in the path of the cooling air flow, but outside the path of the spray water; and, temperature responsive control means for shutting off the flow of spray water at a selected low ambient temperature above freezing and for subsequently turning on the flow of spray water at a selected high ambient temperature, said control being operative to drain the sump of spray water when the spray water flow is shut off and to refill the sump at an intermediate ambient temperature above said low ambient temperature.

2. The system as set forth in claim 1, wherein said low and high ambient temperatures define a range of about 10° F. (5.5° C.).

3. The system as set forth in claim 2, wherein said low and high ambient temperatures are about 40° F. (4.5° C.) and 50° F. (10° C.).

4. The system as set forth in claim 1 wherein the spray water header is supplied by a pump, and said control is operative to generate a refill signal for the sump at an intermediate temperature equal to said high ambient temperature and to delay pump start-up for a selected time period after generation of said refill signal.

5. The system as set forth in claim 1, wherein said supplemental heat exchanging coil comprises:

a metal tube formed in a serpentine pattern and disposed in a horizontal plane; and, a housing extension laterally enclosing said supplemental coil and extending vertically upward from the main housing.

6. The system as set forth in claim 5, wherein said metal tube is surrounded by integrally attached thin metal cooling fins.

7. A method for cool weather operation of an evaporative cooler of the type having a closed loop cooling fluid circulation path including a main heat exchanging coil which coil is disposed in the path of an upward flow of cooling air and a downward flow of spray water supplied from a sump, said method comprising the steps of:

(1) connecting a supplemental heat exchanging coil in series with the main heat exchanging coil and upstream thereof with respect to the flow of cooling fluid;

(2) positioning the supplemental coil in the path of cooling air flow and outside the path of the spray water;

(3) shutting off the flow of spray water and draining the water from the sump at a selected low ambient temperature above freezing; and, (4) refilling the sump and resuming the flow of spray water at selected ambient temperatures above said low ambient temperature.

* * * * *